US006039444A

United States Patent [19]

Mori et al.

[11] Patent Number: 6,039,444

[45] Date of Patent: Mar. 21, 2000

[54] RECORDING MATERIAL

[75] Inventors: Kenichi Mori; Katsuya Ito; Tooru Kotani; Toshitake Suzuki; Yasushi Sasaki, all of Otsu, Japan

[73] Assignee: Toyo Boseki Kabushiki Kaisha, Osaka, Japan

[21] Appl. No.: 09/057,764

[22] Filed: Apr. 9, 1998

[30] Foreign Application Priority Data

May 30, 1997 [JP] Japan ..... 9-141915
May 30, 1997 [JP] Japan ..... 9-141916

[51] Int. Cl.[7] ..... B41M 5/00

[52] U.S. Cl. ..... 347/105; 428/327; 428/446; 428/480; 428/483; 428/523; 428/913

[58] Field of Search ..... 428/323, 327, 428/411.1, 446, 447, 480, 483, 522, 523, 507, 304.4, 913; 347/105

[56] References Cited

U.S. PATENT DOCUMENTS

| | | | |
|---|---|---|---|
| 4,314,259 | 2/1982 | Cairns et al. | 346/75 |
| 4,476,190 | 10/1984 | Clarke et al. | 428/350 |
| 4,517,244 | 5/1985 | Kobayashi et al. | 428/342 |
| 4,887,097 | 12/1989 | Akiya et al. | 346/135.1 |
| 5,262,238 | 11/1993 | Trouve et al. | 428/402 |
| 5,462,910 | 10/1995 | Ito et al. | 503/227 |
| 5,672,424 | 9/1997 | Malhotra et al. | 428/325 |
| 5,676,787 | 10/1997 | Rusincovitch et al. | 156/277 |
| 5,750,253 | 5/1998 | Satake et al. | 428/342 |

OTHER PUBLICATIONS

Database WPI, Week 8712, Derwent Publications Ltd., AN 87–083969 (JP 62035870 abstract).

*Patent Abstracts of Japan*, vol. 12, No. 459 (Dec. 2, 1988) (JP 63183874 abstract).

*Patent Abstracts of Japan*, vol. 12, No. 81 (Mar. 15, 1988) (JP 62221591 abstract).

*Primary Examiner*—Marie Yamnitzky
*Attorney, Agent, or Firm*—Leydig, Voit & Mayer, Ltd.

[57] ABSTRACT

A recording material for use in various printing methods, having a substrate and an ink-receiving layer formed thereon, the ink-receiving layer containing both a water-absorbing anionic polymer and a water-absorbing cationic polymer. The recording material can be used in the high-speed printing without being influenced by the properties of ink.

8 Claims, No Drawings

RECORDING MATERIAL

FIELD OF INVENTION

The present invention relates to a recording material with excellent recording characteristics in various recording methods using aqueous ink, particularly in the ink jet recording. More specifically the present invention relates to a general-purpose recording material which can be used in the high-speed printing regardless of the properties of aqueous ink.

BACKGROUND OF THE INVENTION

In recent years, hard copying technology has made rapid progress with the performance improvement of computers and their spread. As the recording method of hard copying, there have been known, for example, dye diffusion thermal transfer recording, electrophotographic recording, and ink jet recording.

The ink jet printers take a recording method in which ink drops are discharged as a high-speed ink jet from the nozzle of the printer toward the recording paper to be printed. The ink jet printers have been rapidly spread as the terminal units of computers for office, home, or personal use because of their high applicability to full color printing, their easy down sizing, and their low noise in the printing. Furthermore, the ink jet printers have been expected to find applications in various fields of industry, such as large-sized signboards, because of their improvement in printing quality close to silver salt photography and their high applicability to large-scale printing.

The printing by the ink jet recording method is greatly influenced by the properties of ink and recording materials, and the compatibility between the ink and the recording materials, in addition to the performance of hardware.

The ink to be used in the ink jet recording contains a recording agent for image formation and a liquid medium (mainly water) for the dispersion or dissolution of the recording agent as the essential ingredients, and further contains various additives, if necessary, such as dispersing agents, surfactants, viscosity modifiers, resistivity modifiers, pH modifiers, antifungal agents, and stabilizers for the dissolution or dispersion of the recording agent. As the recording agent, there have been used direct dyes, reactive dyes, acidic dyes, basic dyes, food dyes, disperse dyes, or various pigments. For this reason, the properties of ink may vary with the ink-manufacturing makers and the kinds of ink.

Various recording materials to be used in the ink jet recording have been proposed, for example, a recording material with an ink-receiving layer containing an inorganic pigment and a water-soluble resin, and a recording material with an ink-receiving layer composed mainly of a water-soluble resin. In addition, various additives have been proposed for the improvement in the speed of ink absorption into the ink-receiving layer and for the enhancement of water resistance and moisture resistance.

These recording materials are not suitable for the recent high-speed printing and they require the use of specific ink for better printing. This is because many ink products available from different makers have different characteristics.

To increase the speed of ink absorption, a polymer with a polar group, either cationic or anionic, should be incorporated in the ink-receiving layer. Even if an ionic property is given to the ink-receiving layer, the resulting recording material is only suitable for the use of specific ink; in particular, it cannot attain rapid absorption of other ink products with different values of pH.

SUMMARY OF THE INVENTION

Under these circumstances, the present inventors have intensively studied to obtain a recording material which can be used in the high-speed printing without being influenced by the properties of ink. As a result, they have found that such a recording material can be obtained by forming an ink-receiving layer on a substrate, which layer contains both a water-absorbing anionic polymer and a water-absorbing cationic polymer, thereby completing the present invention.

Thus the present invention provides a recording material comprising a substrate and an ink-receiving layer formed thereon, the ink-receiving layer containing both a water-absorbing anionic polymer and a water-absorbing cationic polymer.

DETAILED DESCRIPTION OF THE INVENTION

The recording material of the present invention has a basic structure in which an ink-receiving layer is formed on a substrate.

The thickness of the ink-receiving layer may be determined by the amount of coating as defined below. In contrast, the thickness of the substrate, although it is not particularly limited, may vary with the conditions of printing and particular applications.

The substrate, although it is not particularly limited, may include, for example, natural paper, synthetic paper, cloths, nonwoven fabrics, woods, metals, plastic films, glass, artificial leather, and natural leather. These may be used alone or in combination by making two or more materials into a laminate. Among those preferably used are plastic films in view of their flatness, more preferably polyester films in view of their thermal stability.

The polyester films may preferably be substantially white in view of their shielding property to obtain distinctness after printing. The "white" polyester films are not particularly limited, but may preferably meet the conditions that $L \geqq 80$, $-10 \leqq a \leqq 10$, $-10 \leqq b \leqq 10$, and global luminous transmittance is 50% or less, where "L" is psychometric lightness, "a" and "b" are psychometric chroma coordinates on the surface of a substrate, as determined by the standard methods defined in JIS Z8722 and JIS Z8730. According to these definitions, three values of "L", "a", and "b" express the color tone of an object to be measured, where "L" means lightness, its larger value corresponding to higher lightness; "a" means redness, its larger value corresponding to more intensive redness and its smaller value corresponding to more intensive greenness; and "b" means yellowness, its larger value corresponding to more intensive yellow and its smaller value corresponding to more intensive blueness.

As the "white" polyester film, there may preferably be used a void-containing polyester film or a white pigment-containing polyester film. The void-containing polyester film can be prepared, for example, by a process in which a polyester and a resin incompatible with the polyester are melt kneaded in an extruder, an unstretched sheet containing the resin as fine particles dispersed in the polyester is obtained, and the unstretched sheet is then stretched to form microvoids around the fine particles.

The polyesters used in the present invention are those prepared by polycondensation of an aromatic dicarboxylic acid or an ester thereof, such as terephthalic acid, isophthalic acid, or naphthalenedicarboxylic acid, with a glycol such as ethylene glycol, diethylene glycol, 1,4-dibutanediol, or neopentyl glycol. More particularly, these polyesters can be prepared, for example, by direct reaction of an aromatic dicarboxylic acid with a glycol, or by ester interchange of an aromatic dicarboxylic acid alkyl ester with a glycol and then polycondensation, or by polycondensation of an aromatic dicarboxylic acid diglycol ester. Typical examples of the polyesters are polyethylene terephthalate, polyethylenebutylene terephthalate, and polyethylene-2,6-naphthalate. These polyesters may be homopolymers or copolymers with additional monomers. In any case, the polyesters may preferably contain ethylene terephthalate units, butylene terephthalate units, or ethylene-2,6-naphthalate units at a ratio of 70 mol % or higher, preferably 80 mol % or higher, and more preferably 90 mol % or higher.

The "resin incompatible with the polyester" has to be incompatible with the above polyesters. The incompatible resin may include, for example, polystyrene, polypropylene, polymethylpentene, polyphenylene sulfide, and polyphenylene oxide. The amount of resin is to be adjusted depending upon the desired amount of microvoids. The formation of excessive microvoids may often deteriorate the mechanical and thermal properties of the polyester. Therefore, the amount of resin is preferably adjusted so that the apparent specific gravity of the substrate can be 0.6 or higher.

The white pigment to be contained in the polyester may include various inorganic pigments such as titanium dioxide, silicon dioxide, calcium carbonate, barium sulfate, aluminum oxide, kaolin, talc, and zeolite. The amount of white pigment may be adjusted so that the desired screening property of the substrate can be achieved. Excessive amounts deteriorate the stretchability of the polyester. Therefore, the amount of white pigment is to be appropriately adjusted.

Depending upon the purpose of use, various additives may be added to the substrate, such as coloring agents, light-resisting agents, fluorescent agents, and antistatic agents.

The substrate may be a laminate composed of two surface layers and one core layer, in which the kinds and amounts of resins incompatible with the polyester to be mixed and/or white pigments are made different between the surface layers and the core layer. Such a laminate can be obtained, for example, by extruding the starting materials of the surface layers and the core layer from separate extruders, and then introducing these extrudates into a single die to form an unstretched sheet.

The unstretched sheet may be stretched, for example, by tubular stretching, simultaneous biaxial stretching, or successive biaxial stretching. Preferred is successive biaxial stretching which gives flatness, size stability, and even thickness to the substrate. The successive biaxial stretching is carried out, for example, by roll stretching at a ratio of 2.0 to 5.0 times in the machine direction at a temperature 0° C. to 30° C. higher than the glass transition temperature of the polyester and then tenter stretching at a ratio of 1.2 to 5.0 times at a temperature of 120° C. to 150° C., followed by thermal fixation at a temperature of 220° C. or higher, while causing relaxation at a ratio of 3% to 8%.

The ink-receiving layer contains both a water-absorbing anionic polymer and a water-absorbing cationic polymer. These water-absorbing polymers can be introduced into the ink-receiving layer, for example, by applying a coating liquid containing one water-absorbing polymer to the substrate, followed by drying, and then applying a coating fluid containing the other water-absorbing polymer, followed by drying; or by applying a coating fluid containing both water-absorbing polymers in emulsion state, followed by drying.

The water-absorbing polymers preferably used have water absorbing capacity about 50 to 1000 times the weight of the polymer. In particular, the water-absorbing polymers may preferably have the property of existing as particles in the ink-receiving layer. The water-absorbing polymers existing as particles have no influence between the respective polar groups, making it easy to achieve the objective of the present invention. The particle diameter, although it is not particularly limited, may preferably be 50 μm or smaller, more preferably 10 μm or smaller. If it is larger than 50 μm, large raised portions are formed on the surface of an ink-receiving layer and the resulting recording material has poor texture.

The water-absorbing polymers can be prepared, for example, by the process in which an aqueous solution of a water-soluble vinyl monomer and a crosslinkable monomer is emulsified in an organic dispersion medium with a hydrophobic surfactant and then polymerized with an initiator of radical polymerization or the like to give a water-in-oil (W/O-type) emulsion of the water-absorbing polymer. This emulsion may be evaporated to dryness, so that the water-absorbing polymer is separated and then incorporated into a coating fluid to form an ink-receiving layer. In the case of a W/O-type emulsion, admixture of an anionic polymer and a cationic polymer causes no gelation; therefore, the emulsion may preferably be used without further treatment in the coating fluid to form an ink-receiving layer.

The water-soluble vinyl monomer used in the preparation of water-absorbing cationic polymers may include, for example, neutralization salts or quaternization derivatives of dialkylaminoalkyl(meth)acrylates such as dimethylaminoethyl(meth)acrylates and diethylaminoethyl (meth)acrylates; and dialkylaminoalkyl(meth)acrylamides such as dimethylaminomethyl(meth)acrylamide and dimethylaminopropyl(meth)acrylamide. The water-soluble vinyl monomer used in the preparation of water-absorbing anionic polymers may include, for example, (meth)acrylic acid, 2-acrylamide-2-methylpropanesulfonic acid, vinylsulfonic acid, styrenesulfonic acid, itaconic acid, maleic acid, fumaric acid, and arylsulfonic acid.

The crosslinkable monomer is not particularly limited, so long as it is copolymerizable with the water-soluble vinyl monomer, but may include, for example, divinyl compounds such as N,N'-methylenebis(meth)acrylamide, divinylbenzene, and vinyl (meth)acrylate; vinylmethylol compounds such as methylol(meth)acrylamide; vinylaldehyde compounds such as acrolein; and methyl acrylamidoglycolate methyl ether.

The water-absorbing polymers are commercially available, such as Acogel-A (Mitsui Scitec) for anionic one and Acogel-C (Mitsui Scitec) for cationic one.

The weight ratio of water-absorbing anionic polymer to water-absorbing cationic polymer is preferably in the range of 10/90 to 90/10, more preferably 20/80 to 80/20. If the water-absorbing anionic polymer is at lower percentage, the ink-absorbing capacity is decreased for alkaline ink, particularly alkaline ink containing a pigment dispersed therein, which is responsible for ink bleeding. In contrast, if the water-absorbing cationic polymer is at lower percentage, the ink-absorbing capacity is decreased for acidic ink or ink containing an anionic dye dissolved therein, which is also responsible for ink bleeding.

The ink-receiving layer may preferably contain an additional resin to make an improvement in surface strength. The resin can be incorporated into the ink-receiving layer, for example, by the overcoating method in which the resin is applied to the surface of a coating film composed mainly of water-absorbing polymers or by the method in which the resin is mixed with water-absorbing polymers in the preparation of a coating fluid, which is applied to the surface of a substrate and then dried. The latter method is preferred because of a fewer producing steps.

As the resin contained in the ink-receiving layer, various resins can be used, such as polyester resins, polyurethane resins, polyester-urethane resins, acrylic resins, melamine resins, polyvinyl alcohol resins, polyvinylpyrrolidone, methylcellulose, and mixtures thereof. Preferred are acrylic resins which are water-insoluble resins making an improvement in the water resistance of the ink-receiving layer.

The weight ratio of water-absorbing polymers to additional resin is preferably in the range of 99/1 to 25/75, more preferably 95/5 to 40/60. If the resin is at higher percentage, the ink-absorbing capacity is decreased. In contrast, if the resin is at lower percentage, there is no improvement in surface strength.

The term "water-absorbing cationic polymer" used herein refers to a polymer having a cationic group in the molecule and capable of absorbing water in an amount greater than the weight of the polymer.

The term "water-absorbing anionic polymer" used herein refers to a polymer having an anionic group in the molecule and capable of absorbing water in an amount greater than the weight of the polymer.

The ink-receiving layer may preferably contain a silicon compound. Because the recording material of the present invention has excellent ink-absorbing capacity, the addition of a silicon compound has substantially no effects on the ink-absorbing capacity in the range of ordinary ink amounts (less than 250% relative to 100% for each color of cyan, magenta, yellow, and black, i.e., 400% in total); however, when the ink amount is larger (i.e., 250% or more), the ink-absorbing capacity can be further improved by the addition of a silicon compound.

The silicon compound may include, for example, dimethylsilicon, aminosilane, acrylsilane, vinylbenzylsilane, vinylbenzylaminosilane, glycidosilane, mercaptosilane, dimethylsilane, polydimethylsiloxane, polyalkoxysiloxane, hydrodiene-modified siloxanes, vinyl-modified siloxanes, hydroxy-modified siloxanes, amino-modified siloxanes, carboxyl-modified siloxanes, halogenation-modified siloxanes, epoxy-modified siloxanes, methacryloxy-modified siloxanes, mercapto-modified siloxanes, fluorine-modified siloxanes, alkyl-modified siloxanes, phenyl-modified siloxanes, and alkylene oxide-modified siloxanes. The alkyl-modified siloxanes are preferred because of their higher water repellency. The amount of silicon compound to be added should be optimized depending upon the ink amount in a printer to be used. As described above, the addition of a silicon compound has substantially no effect in printers with smaller ink amounts; however, for printers with larger ink amounts, it is preferred to add a silicon compound to the ink-receiving layer in an amount of 0.01% to 30% by weight. Amounts larger than 30% by weight deteriorate the friction properties. Even for printers with smaller ink amounts, the addition of a silicon compound in the above appropriate range is preferred for the general use of a recording material because there is substantially no adverse effect.

The ink-receiving layer may further contain various additives to an extent that the ink-absorbing capacity and other physical properties are not deteriorated. The additives may include, for example, fluorescent dyes, plasticizers, ultraviolet light-absorbing agents, inorganic pigments, organic pigments, surfactants, and cationic polymers.

The formation of an ink-receiving on a substrate, although it is not particularly limited, may be carried out by any of the ordinary coating techniques employed in the art, such as gravure coating, kiss coating, dip coating, spray coating, curtain coating, air-knife coating, blade coating, reverse-roll coating or bar coating. The amount of coating, although it is not particularly limited, may preferably be in the range of 1 $g/m^2$ to 50 $g/m^2$.

The surface of the ink-receiving layer may be treated, if necessary, with various kinds of finish, e.g., gloss finish, tacky finish, and formation of a screening property-modifying layer and an ultraviolet light-absorbing layer.

The back of the substrate, i.e., the reverse side of the substrate on which the ink-receiving layer has not been formed, may also be treated, if necessary, with various kinds of finish, e.g., antistatic finish, tacky finish, and formation of a screening property-conferring layer, an ultraviolet light-absorbing layer, and a hard coat.

For the recording material of the present invention, any aqueous ink containing water as the main ingredient can be used. It may be composed of a recording agent for image formation and a liquid medium (containing water as the main ingredient) to disperse or dissolve the recording agent; if necessary, it may further contain various additives such as dispersing agents, surfactants, viscosity modifiers, resistivity modifiers, pH modifiers, anti-fungal agents, and stabilizers for the stable dissolution or dispersion of the recording agent. As the recording agent, there can be used direct dyes, reactive dyes, acidic dyes, basic dyes, food dyes, disperse dyes, or various pigments. The recording material of the present invention can be adapted to a wide range of ink pH, and the absorption of ink can be attained thereby without any trouble, even with ink of pH 3 to 12.

The recording material thus obtained can be used in the high-speed printing without being influenced by the properties of ink.

The present invention will be further illustrated by the following examples and comparative examples; however, the present invention is not limited to these examples.

EXAMPLES

The methods of measurement or evaluation used in the examples and comparative examples are described below.

1) First Printing Characteristics

An illustration image having some 2 cm×2 cm images ranging from 400% solid color (i.e., a mixed color of 100% cyan, 100% magenta, 100% yellow, and 100% black) to 100% solid color (i.e., a mixed color of 25% cyan, 25% magenta, 25% yellow, and 25% black) solid in 100% solid yellow is prepared with Illustrator 7.0J of Adobe. The data of this illustration image are transferred through an RIP in VI225 of Vivid Color having Laser Write 8 as a driver and being under the "OFF" state of color correction to an ink jet printer, Nova Jet Pro of EnCAD. The illustration image is printed with the ink jet printer and genuine ink products (i.e., 206864GO, 206863GO, 206862GO, and 206861GO; pH=8–9) at the jet rate of 7500 Hz through four paths in the bi-directional mode. The printed matter is then examined for the bleeding portions of 1 mm or more in width and the greatest color percentage in these portions is taken as the bleeding (%). If images can be printed up to 250% color without bleeding, this case is usually on the level causing no troubles in practical use. The drying characteristics of the printed matter is determined by measuring a drying time in the 200% color image portion at a touch by hand. Shorter drying times are preferred in view of adaptation to the high-speed printing.

2) Second Printing Characteristics

PIG

A photograph-like image of the A1 size is printed with Nova Jet PRO of EnCAD and genuine ink products (i.e., 206864GO, 206863GO, 206862GO, and 206861GO; pH=8–9) at the jet rate of 7500 Hz through four paths in the bi-directional mode under color correction. The printed matter is then evaluated by visual observation in four levels (i.e., ◎: no bleeding; ○: slight bleeding but sharp at a distant of one meter; Δ: bleeding even at a distance of one meter, and less sharp; X: bleeding even at a distance of one meter, and poor).

DYE 1

A photograph-like image of the A1 size is printed with Nova Jet PRO of EnCAD and genuine ink products (i.e., 205140GA, 205141GA, and 205142GA; pH=8–9) at the jet rate of 7500 Hz through four paths in the bi-directional mode under color correction. The printed matter is then evaluated by visual observation in four levels (i.e., ◎: no bleeding; ○: slight bleeding but sharp at a distant of one meter; Δ: bleeding even at a distance of one meter, and less sharp; X: bleeding even at a distance of one meter, and poor).

DYE 2

A photograph-like image of the A1 size is printed with HP-750C of Hewlett Packard and genuine ink products (i.e., 51645A, 51644C, 51644M, and 51644Y; pH=6–9) in the high-quality mode under color correction. The printed matter is then evaluated by visual observation in four levels (i.e., ◎: no bleeding; ○: slight bleeding but sharp at a distant of one meter; Δ: bleeding even at a distance of one meter, and less sharp; X: bleeding even at a distance of one meter, and poor).

3) Distinctness

A recording material with a photograph-type image printed thereon is put up on a black wall and evaluated by visual observation at a distance of one meter in three levels (i.e., ○: distinct; Δ: slightly dull; X: dull).

Example 1

A coating fluid was prepared from 40% by weight of a water-absorbing anionic polymer (Acogel-A from Mitsui Scitec; 40% solid content), 40% by weight of a water-absorbing cationic polymer (Acogel-C from Mitsui Scitec; 40% solid content), and 20% by weight of an acrylic resin (Acrydic A-1300 from DIC; 60% solid content). The coating fluid was applied to the surface of a void-containing polyester film (Crisper G2323, which is polyester type synthetic paper from Toyobo; L=90, a=−0.5, and b=0 as measured with differential colorimeter CR-100 of Minolta) by the bar coating method and then dried at 160° C. for 3 minutes to give a recording material. The application amount was 15 g/m$^2$ after the drying.

Examples 2 to 5

Four different recording materials were obtained in the same manner as described in Example 1, except that the weight ratio of water-absorbing anionic polymer to water-absorbing cationic polymer was changed as shown in Table 1.

TABLE 1

| | Water-absorbing cationic polymer (wt %) | Water absorbing anionic polymer (wt %) | Acrylic resin (wt %) | Silicon compound (wt %) |
|---|---|---|---|---|
| Example 1 | 40 | 40 | 20 | 0 |
| Example 2 | 60 | 20 | 20 | 0 |
| Example 3 | 20 | 60 | 20 | 0 |
| Example 4 | 48 | 48 | 2 | 0 |
| Example 5 | 30 | 30 | 40 | 0 |
| Example 6 | 40 | 40 | 19 | 1 |
| Example 7 | 40 | 40 | 15 | 5 |
| Comparative Example 1 | 100 | 0 | 20 | 0 |
| Comparative Example 2 | 0 | 100 | 20 | 0 |

Example 6

A coating fluid was prepared from 40% by weight of a water-absorbing anionic polymer (Acogel-A from Mitsui Scitec; 40% solid content), 40% by weight of a water-absorbing cationic polymer (Acogel-C from Mitsui Scitec; 40% solid content), 19% by weight of an acrylic resin (Acrydic A-1300 from DIC; 60% solid content), and 1% by weight of a silicon compound (Paintat H from Dow Corning, 10% solid content). The coating fluid was applied to the surface of a void-containing polyester film (Crisper G2323, which is synthetic paper of the polyester type, from Toyobo; L=90, a=−0.5, and b=0 as measured with differential calorimeter CR-100 of Minolta), by the bar coating method and then dried at 160° C. for 3 minutes to give a recording material. The application amount was 15 g/m$^2$ after the drying.

Example 7

A recording material was obtained in the same manner as described in Example 1, except that the amounts of the acrylic resin and the silicon compound were changed to 15% and 5% by weight, respectively.

Comparative Examples 1 and 2

Two different recording materials were obtained in the same manner as described in Example 1, except that the weight ratio of water-absorbing anionic polymer to water-absorbing cationic polymer was changed as shown in Table 1.

Comparative Example 3

A recording material was obtained in the same manner as described in Example 1, except that a transparent polyester film (A4100 from Toyobo) was used as a substrate.

The recording materials thus obtained were evaluated for the first and second printing characteristics and distinctness. The results are shown in Table 2.

TABLE 2

| | First printing characteristics | | Second printing characteristics | | | |
|---|---|---|---|---|---|---|
| | Bleeding (%) | Drying (min.) | PIG | DYE 1 | DYE 2 | Distinctness |
| Example 1 | 300 | 8 | ○ | ○ | ○ | ○ |
| Example 2 | 260 | 10 | ○ | ○ | ○ | ○ |
| Example 3 | 320 | 6 | ○ | ○ | ○ | ○ |
| Example 4 | 320 | 6 | ○ | ○ | ○ | ○ |
| Example 5 | 260 | 10 | ○ | ○ | ○ | ○ |
| Example 6 | 340 | 4 | ○ | ○ | ○ | ○ |
| Example 7 | 360 | 4 | ○ | ○ | ○ | ○ |
| Comparative Example 1 | 200 | 60 | x | ○ | ○ | ○ |
| Comparative Example 2 | 260 | 20 | ○ | Δ | x | ○ |
| Comparative Example 3 | 300 | 8 | ○ | ○ | ○ | x |

As can be seen from Table 2, the recording materials of Examples 1 to 7 gave high-quality printed images for all the printers used because their ink-receiving layers contained both a water-absorbing cationic polymer and a water-absorbing anionic polymer. In particular, the recording materials of Examples 6 and 7 had an improvement in bleeding characteristics because their ink-receiving layers further contained a silicon compound.

In contrast, the recording materials of Comparative Examples 1 and 2 gave no high-quality printed images for all the printers used because their ink-receiving layers contained either the water-absorbing cationic polymer or the water-absorbing anionic polymer. The images printed on the recording material of Comparative Example 3 was not distinct because a transparent film was used as the substrate.

We claim:

1. A method of ink jet recording comprising ink jet recording on an ink-receiving layer of a recording material including a substrate and an ink-receiving layer formed thereon, the ink-receiving layer containing both a water-absorbing anionic polymer and a water-absorbing cationic polymer, wherein the water-absorbing anionic and cationic polymers are in the form of water-absorbing resin particles.

2. The method according to claim 1, wherein the weight ratio of the water-absorbing anionic polymer to the water-absorbing cationic polymer is in the range of 20/80 to 80/20.

3. The method according to claim 1, wherein the water-absorbing anionic and cationic polymers are obtained by emulsifying an aqueous solution of a water-soluble vinyl monomer and a crosslinkable monomer in an organic dispersion medium with a hydrophobic surfactant, and then causing polymerization.

4. The method according to claim 1, wherein the ink-receiving layer further contains a silicon compound.

5. The method according to claim 1, wherein the substrate is a polyester film.

6. The method according to claim 1, wherein the substrate is a void-containing polyester film.

7. The method according to claim 1, wherein the substrate is a white pigment-containing polyester film.

8. The method according to claim 1, wherein the water-absorbing anionic and cationic polymers have water-absorbing capacity 50 to 1000 times the weight of the polymer.

* * * * *